US006601875B2

(12) United States Patent
Barre

(10) Patent No.: US 6,601,875 B2
(45) Date of Patent: Aug. 5, 2003

(54) LABEL, ESPECIALLY, FOR A PACKAGE FOR A COSMETIC PRODUCT

(75) Inventor: Patrice Barre, Antony (FR)

(73) Assignee: L'Oreal, Paris (FR)

( * ) Notice: Subject to any disclaimer, the term of this patent is extended or adjusted under 35 U.S.C. 154(b) by 68 days.

(21) Appl. No.: 09/832,804

(22) Filed: Apr. 12, 2001

(65) Prior Publication Data

US 2001/0011822 A1 Aug. 9, 2001

Related U.S. Application Data

(62) Division of application No. 09/227,351, filed on Jan. 8, 1999.

(30) Foreign Application Priority Data

Jan. 21, 1998 (FR) ..... 98 00613

(51) Int. Cl.[7] ..... B42D 15/00

(52) U.S. Cl. ..... 283/81; 283/101; 283/117; 283/109; 40/310

(58) Field of Search ..... 283/107, 108, 283/109, 110, 111, 81, 101, 91, 94, 113; 40/310, 615; 427/517; 428/913.3, 918

(56) References Cited

U.S. PATENT DOCUMENTS 4,273,816 A * 6/1981 Tollette ..... 40/615
5,492,733 A * 2/1996 D'Anna et al. ..... 427/517

FOREIGN PATENT DOCUMENTS

JP 406064077 * 3/1994 ..... 156/250

* cited by examiner

*Primary Examiner*—Willmon Fridie, Jr.
(74) *Attorney, Agent, or Firm*—Oblon, Spivak, McClelland, Maier & Neustadt, P.C.

(57) ABSTRACT

A label (1), intended to be applied especially to a package for a cosmetic product, is formed of a substrate (2) one side (6) of which is printed, and a film (8) of nonwoven material placed on the printed side (6) of the substrate. The film (8) is transparent so that the printing on the substrate (2) can be seen through the film (8).

27 Claims, 1 Drawing Sheet

LABEL, ESPECIALLY, FOR A PACKAGE FOR A COSMETIC PRODUCT

BACKGROUND OF THE INVENTION

1. Field of the Invention

The present invention relates to a label intended to be applied especially to a package for a cosmetic product. The label is most particularly suitable for bottles, such as those used for packaging shampoos, lotions, beauty creams or gels, especially washing gels.

2. Description of the Related Art

Conventionally, labels used in the field of cosmetics are formed from self-adhesive sheets made of materials such as high-density polyethylenes, polypropylenes, polyvinyl chlorides, polyethylene terephthalates and paper. The opposite side of the sheet from the adhesive layer is printed, especially using screen printing, letterpress printing, flexography or offset printing. Optionally, a varnish is deposited on the printed side. Such labels are characterized by a relatively smooth "feel".

In this field of the packaging of cosmetic products, new concepts are always being sought both in terms of the visual appearance of the package, and of its functional characteristics, and in terms of its sensory aspect, particularly its feel. Thus, a demand has arisen for replacing the traditional "feel" of thermoplastic-type bottles with warmer, softer types of feel, such as those provided by fabrics.

Printing on materials such as nonwovens turns out to cause problems, especially in terms of the resolution of the printing. These problems are especially due to the coarse characteristics of such materials compared with what may be obtained with woven fabrics. Thus, Japanese Application JP-A-7040514 suggests covering the nonwoven material with a printing layer based on a polyester resin. Apart from the drawback due to the cost of such an operation, this approach has the drawback of significantly affecting the feel of the nonwoven material which, because of the presence of the polyester resin, is similar to the conventional types of feel of thermoplastics.

SUMMARY OF THE INVENTION

One of the objects of the invention is therefore to produce a label which is especially suitable for the decoration and marking of packaging for cosmetic products and which provides a feel and an appearance that differ from those of conventional labels.

Another object of the invention is to provide a low-cost label allowing good printing resolution and having a feel of the fabric type.

Yet another object of the invention is to produce a package provided with a label according to the invention.

According to a first aspect of the invention, these and other objects are achieved by a label, intended to be applied especially to a package for a cosmetic product, comprising a printed substrate and a film of nonwoven material placed on the printed substrate, the film being transparent so that the printing on the substrate can be seen through the film.

The label has the feel of the fabric and retains the excellent printability characteristics, especially in terms of print resolution, of conventional labels. Apart from the sensation that it gives, this feel, above all in the cosmetics field, is most particularly advantageous in that it improves the graspability of the container provided with such a label, particularly when such a container is intended to be used in the bathroom environment, especially under the shower.

Advantageously, the opposite side of the substrate from the film of nonwoven material is covered with an adhesive layer to which a peel-off sheet is affixed before being applied to the package, that side of the peel-off sheet in contact with the adhesive layer being covered with a non-stick material, especially silicone. The label may, however, not be of the self-adhesive type. In this case, before affixing the label to the surface intended to receive it, either the label or the surface is coated with an adhesive composition.

Such a sheet may consist of a material chosen especially from among polyethylene terephthalates, polypropylenes and paper.

According to a preferred embodiment, the film of nonwoven material is fastened to the substrate by bonding, by means of an adhesive or a varnish.

The substrate may consist of a material chosen from among high-density polyethylenes, polypropylenes, polyvinyl chlorides, polyethylene terephthalates and paper. Its thickness may be from 20 $\mu$m to 200 $\mu$m, and preferably from 40 $\mu$m to 100 $\mu$m. Such a substrate must not be too thick so that the final label is suitably flexible in order to follow the contour of the surface to which the label is affixed. The substrate is preferably transparent, in which case the printed side of the substrate may either be the side facing the film of nonwoven material or be on the opposite side from the film of nonwoven material.

The nonwoven material may be a nonwoven of thermoplastic fibers, especially polyolefin fibers, such as polypropylene or polyethylene fibers, or polyester fibers. Its color is preferably white, or slightly tinted. The feel obtained varies depending on the nature and the thickness of the nonwoven material. In fact, it is possible to obtain very varied types of appearance and of feel, which may range from silky to rough, passing through a multitude of gradations, depending on the characteristics sought.

Typically, the film of nonwoven material has a thickness of from 20 $\mu$m to 500 $\mu$m, and preferably from 100 $\mu$m to 300 $\mu$m. This thickness must not be too great so that the film is sufficiently transparent for the printed decoration to be visible. However, it must be sufficient to give the desired feel.

Another aspect of the invention provides a container having a label according to the first aspect. Such a container preferably consists of a bottle, such as one used conventionally for packaging shampoos, washing gels, lotions, etc. Again by way of example, such a label may be affixed to a can such as an aerosol-can, or to a tube.

BRIEF DESCRIPTION OF THE DRAWINGS

Apart from the arrangements explained above, the invention consists of a number of other arrangements which will be explained below with regard to non-limiting embodiments described with reference to the appended Figures, among which.

DETAILED DESCRIPTION OF THE PREFERRED EMBODIMENT

Figure 1:
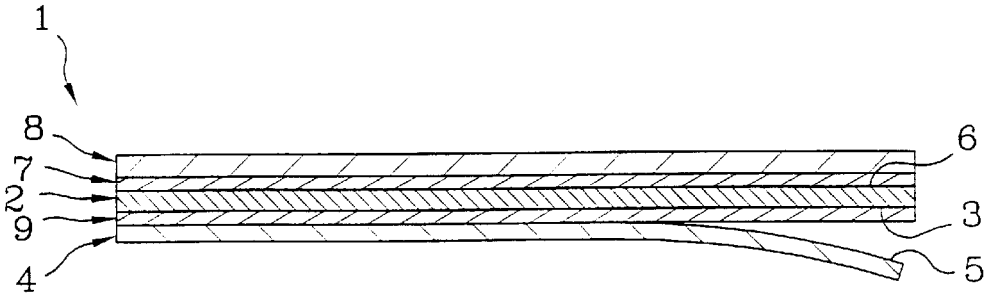
FIG. 1 shows a cross-sectional view of a preferred embodiment of a label according to the invention.

The label 1 shown in FIG. 1 has a printable substrate 2 which may or may not be transparent, and which is made of high-density polyethylene, of polypropylene, of polyvinyl chloride, of paper or of polyethylene terephthalate. Purely by way of example, in the case of a high-density polyethylene substrate, its thickness is about 80 to 100 μm. In the case of a polypropylene, its thickness is about 40 to 60 μm. In the case of paper, its thickness is about 100 μm. Other materials may also be used.

One side 6 of the substrate is printed and bears information relating especially to the identification of the product and to its brand or commercial name, or any other information for purely decorative purposes. The printing is effected by any known technique, especially by screen printing, letterpress printing, flexography or offset printing.

The side 3 of the support 2 opposite the printed side 6 is covered with an adhesive composition 9 on which is removably deposited a peel-off sheet 4 consisting of a material chosen especially from among polyethylene terephthalates, polypropylenes and paper. That side 5 of the peel-off sheet 4 in contact with the adhesive composition 9 is covered with a non-stick layer, especially a silicone layer. The sheet 4 is removed just before applying the label 1 to the package.

Deposited on the printed side 6 of the substrate is an adhesive layer 7, especially an adhesive or a varnish having good adhesive properties.

A film 8 of carded nonwoven material covers the printed side of the substrate 2, to which side the film adheres by means of the adhesive layer 7. Such a film of nonwoven material is formed from a relatively tightly entangled mass of fibers, especially synthetic fibers, which are bonded together in a conventional manner, by hot lamination, by passing them between two rollers one of which is heated and has embossing opposite which the points of bonding will be formed. By way of example, a polyolefin nonwoven material, especially a polypropylene or polyethylene nonwoven material, is used. As a variant, a polyester nonwoven material is used. The thickness of the film 8 may be about 100 μm to 300 μm.

With such an embodiment, because of the contact transparency of the film of nonwoven material, the information printed on the side 6 of the substrate 2 can be seen through the film of nonwoven material.

Figure 2:
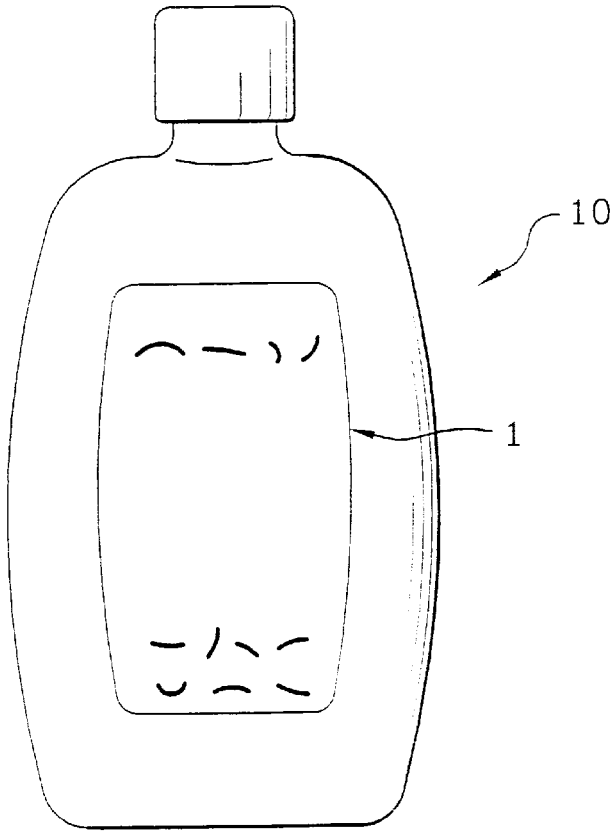
FIG. 2 shows an embodiment of a container according to the invention.

FIG. 2 shows an embodiment of a container 10 covered with a label as described in FIG. 1. Such a container may be in the form of a bottle of ovoid cross section, whose body has two main faces, the label 1 being affixed to one of these two main faces. Likewise, such a container could consist of a tube or a can, for example an aerosol or spray-can.

In the above detailed description, reference was made to preferred embodiments of the invention. It is obvious that variants may be made thereto without departing from the scope of the invention as claimed hereinafter.

What is claimed is:

1. A label to be applied to a package for a cosmetic product, comprising:

a printed substrate; and a film of nonwoven fibrous material placed on the printed substrate, said film being sufficiently transparent that the printing on the substrate can be seen through said film, wherein the film of nonwoven material has a thickness of from 20 μm to 500 μm.

2. The label according to claim 1, wherein the film of nonwoven material has a thickness of from 100 μm to 300 μm.

3. A container having a label comprising:

a printed substrate; and a film of nonwoven fibrous material placed on the printed substrate, said film being sufficiently transparent that the printing on the substrate can be seen through said film, wherein the film of nonwoven material has a thickness of from 20 μm to 500 μm.

4. The container according to claim 3, wherein the film of nonwoven material has a thickness of from 100 μm to 300 μm.

5. A label as recited in claim 1, wherein said film of nonwoven fibrous material comprises a carded nonwoven fibrous material.

6. A label as recited in claim 1, wherein said film comprises synthetic fibers.

7. A label to be applied to a package for a cosmetic product, comprising:

a printed substrate; and a film of nonwoven fibrous material placed on the printed substrate, said film being sufficiently transparent that the printing on the substrate can be seen through said film, wherein the film of nonwoven material has a thickness of from 20 μm to 500 μm, and wherein said substrate includes a printed side and a side opposite to said printed side, said label further comprising means for attaching said film to said substrate.

8. A label as recited in claim 7, wherein said film is attached to said printed side of said substrate.

9. A label as recited in claim 8, further comprising means for attaching said substrate to a container, wherein said means for attaching said substrate to a container is disposed on said side opposite to said printed side of said substrate.

10. A label as recited in claim 9, further comprising a peel-off sheet disposed on said means for attaching said substrate to a container.

11. A label as recited in claim 1, wherein said film of nonwoven fibrous material is an outermost layer of said label such that said film is exposed to touch.

12. A container as recited in claim 3, wherein said film of nonwoven fibrous material comprises a carded nonwoven fibrous material.

13. A container as recited in claim 3, wherein said film comprises synthetic fibers.

14. A container having a label comprising:

a printed substrate; and a film of nonwoven fibrous material placed on the printed substrate, said film being sufficiently transparent that the printing on the substrate can be seen through said film, wherein the film of nonwoven material has a thickness of from 20 μm to 500 μm, and wherein said substrate includes a printed side and a side opposite to said printed side, said container further comprising means for attaching said film to said substrate.

15. A container as recited in claim 14, wherein said film is attached to said printed side of said substrate.

16. A container as recited in claim 15, further comprising means for attaching said side opposite to said printed side of said substrate to said container.

17. A container as recited in claim 3, wherein said film of nonwoven fibrous material is an outermost layer of said label such that said film is exposed to touch.

18. A container as recited in claim 3, wherein said printed substrate is disposed between said film and said container.

19. The label according to claim 7, wherein the film of nonwoven material has a thickness of from 100 μm to 300 μm.

20. A label as recited in claim 7, wherein said film of nonwoven fibrous material comprises a carded nonwoven fibrous material.

21. A label as recited in claim 7, wherein said film comprises synthetic fibers.

22. A label as recited in claim 7, wherein said film of nonwoven fibrous material is an outermost layer of said label such that said film is exposed to touch.

23. A container according to claim 14, wherein the film of nonwoven material has a thickness of from 100 $\mu$m to 300 $\mu$m.

24. A container as recited in claim 14, wherein said film of nonwoven fibrous material comprises a carded nonwoven fibrous material.

25. A container as recited in claim 14, wherein said film comprises synthetic fibers.

26. A container as recited in claim 14, wherein said film of nonwoven fibrous material is an outermost layer of said label such that said film is exposed to touch.

27. A container having a label comprising:

a printed substrate; and a film of nonwoven fibrous material placed on the printed substrate, said film being sufficiently transparent that the printing on the substrate can be seen through said film, wherein said substrate includes a printed side and a side opposite to said printed side, said film being attached to said substrate.

* * * * *